US005097674A

United States Patent [19]

Imaiida et al.

[11] Patent Number: 5,097,674

[45] Date of Patent: Mar. 24, 1992

[54] AIR CONDITIONING APPARATUS

[75] Inventors: Tsuyoshi Imaiida, Nagoya; Takeshi Itoh, Nagpua; Hiroki Nozoe, Nishi-kasugai; Iwanori Katoh, Nishi-kasugai; Hiroshi Sakai, Nishi-kasugai, all of Japan

[73] Assignee: Mitsubishi Jukogyo Kabushiki Kaisha, Tokyo, Japan

[21] Appl. No.: 662,462

[22] Filed: Feb. 28, 1991

Related U.S. Application Data

[63] Continuation-in-part of Ser. No. 381,520, Jul. 17, 1989, Pat. No. 5,029,451.

[30] Foreign Application Priority Data

| | | | |
|---|---|---|---|
| Sep. 12, 1988 | [JP] | Japan | 63-120292[U] |
| Sep. 13, 1988 | [JP] | Japan | 63-120291[U] |
| Sep. 13, 1988 | [JP] | Japan | 63-120293[U] |
| Sep. 13, 1988 | [JP] | Japan | 63-229528 |
| Sep. 13, 1988 | [JP] | Japan | 63-229529 |
| Sep. 14, 1988 | [JP] | Japan | 63-119824[U] |
| Sep. 14, 1988 | [JP] | Japan | 63-119825[U] |
| Sep. 14, 1988 | [JP] | Japan | 63-119826[U] |
| Sep. 14, 1988 | [JP] | Japan | 63-228852 |
| Sep. 30, 1988 | [JP] | Japan | 63-128279[U] |
| Sep. 30, 1988 | [JP] | Japan | 63-128280 |

[51] Int. Cl.[5] ..... F25D 23/12

[52] U.S. Cl. ..... 62/259.1; 62/DIG. 16; 454/236; 454/292

[58] Field of Search ..... 62/259.1, DIG. 16; 98/31.6

[56] References Cited

U.S. PATENT DOCUMENTS 2,389,440 11/1945 Kucher ..... 62/DIG. 16

*Primary Examiner*—Albert J. Makay
*Assistant Examiner*—William C. Doerrler
*Attorney, Agent, or Firm*—McGlew & Tuttle

[57] ABSTRACT

An air conditioning apparatus is provided with an air conditioner embedded in a ceiling of a room provided with an air inlet port opening to the room, a heat exchanger and a blower. A duct box is connected to the air conditioner through a blow-off casing provided on the duct box to project air into the room via an air outlet opening to the room. A fan is disposed on a lower portion of the blow-off casing. A diffuser is provided for redirecting conditioning air from a vertical direction to a substantially horizontal direction. The fan is rotatable forward and backward and includes an outer rotor motor and a plurality of blades fixedly attached to an outer peripheral surface of an outer rotor of the motor.

7 Claims, 16 Drawing Sheets

AIR CONDITIONING APPARATUS

This is a continuation-in-part application of application Ser. No. 07/381,520 filed July 17, 1989, now U.S. Pat. No. 5,029,451 issued July 9, 1991.

FIELD OF THE INVENTION AND RELATED ART STATEMENT

This invention relates to an air conditioning apparatus.

As shown in FIGS. 21 and 22, a wall air conditioner 101 which has been conventionally in wide use is provided on an upper portion of a wall surface 103 in a room 102.

When warm air is blown out of the wall air conditioner 101 in the direction indicated by an arrow A under the heating operation of the wall air conditioner 101, the temperature distribution in the room 102 comes to be as shown by a solid line. On the other hand, when warm air is blown out in the direction indicated by an arrow B, the temperature distribution in the room 102 comes to be as shown by a broken line. In consequence, the warm air does not cover the room 102 wholly in either case to thereby produce air stagnant sections 105 in corners of the room 102.

Further, as shown in FIGS. 23 and 24, in the case where an anemostat type air outlet 107 is bored in a ceiling 106 and then warm air is blown out of the air outlet 107 slantwise downwardly, the temperature distribution in the room 102 comes to be as shown a solid line, so that the above case involves the problem in that air stagnant sections 205 are produced in corners of the room 102.

Then, as shown in FIGS. 25 and 26, there is provided a ceiling fan 108 on a central portion of the ceiling 106 to forcibly stir air in the room 102 by rotating the ceiling fan forward and backward. However, the air stagnant sections 105 ar still produced in the room 102.

On the other hand, as described in U.K. Patent No. 760732, French Patent No. 7526804 and Japanese Utility Model Application No. Sho 62-160812 filed by the present applicant, there is proposed an air conditioning apparatus, in which conditioning air is blown out through a fan having a plurality of hollow blades, as shown in FIG. 27.

However, in the air conditioning apparatus as noted above, since each of the hollow blades 110 is cooled by cool air passing therethrough under the cooling operation, the above apparatus has a defect in that water resulting from dew condensation on the surface of each hollow blade 110 drops into the room 102 by the action of room air in contact with each hollow blade 110. Further, since the conditioning air flows through the inside of each hollow blade 110, a rotary shaft 111 and a boss 112, the flow resistance of air is increased to accordingly produce problems in that a motor 113 increases in size with an accompanying increase of current consumption and noise thereof.

Hence, the present applicant has already proposed an air conditioning apparatus as shown in FIG. 28 according to Japanese Utility Model Application No. Sho 63-1248.

Referring to FIG. 28, air in the room 102 is drawn from an inlet port 117 bored in a body 116 of a conditioning air generator 115 embedded in the ceiling 106, and then the drawn air is heated or cooled in a process of flowing the air through a heat exchanger 118 to thereby provide conditioning air. Then, the conditioning air, after being urged by an air blower 119, passes through a duct 120 and enters a blow-off casing 121 fixedly attached to the ceiling 106 to be blown out of an air outlet 122 into the room 102. Further, the conditioning air is mixed and stirred with the room air in the neighborhood of the ceiling 106 by rotatably driving a propeller fan 123 disposed below the air outlet 122 by the use of a motor 124, and thereafter the resultant air is gradually descended to the lower side of the room 102 to be diffused.

The above air conditioning apparatus is effective in forming the uniform temperature distribution free from stagnation of air. However, since the blow-off casing 121 is directly connected with the duct 120, the conditioning air enters the blow-off casing 121 from the duct 120 with a great dynamic pressure. As a result, the secondary flow of air is produced in bent portions of the duct 120 and blow-off casing 121 or the like to provide the deviated flow of air, so that there is no possibility of uniformly blowing the conditioning air out of the air outlet 122. Further, the above apparatus involves the problem in that sound produced by air flow is increased since the conditioning air flow has a large dynamic pressure component.

Further, since the conditioning air flow descends inside the blow-off casing 121 and collides with a cover 125 to change its direction horizontally, the swirl, entrainment and counterflow of air current are disadvantageously produced as shown in the drawing indicated by an arrow. Therefore, not only the noise and pressure loss are increased, but also a drive motor 124 provided inside the cover 125 is liable to seize since the warm air butts against the cover 125 to heat the cover in the heating operation, and the outer surface of the cover 125 is subjected to dew condensation by a difference in temperature between the cooling air flow butting against the cover 125 and the exothermic drive motor 124 in the cooling operation to scatter water resulting from the dew condensation into the room 102.

OBJECT AND SUMMARY OF THE INVENTION

It is an object of the present invention to provide an air conditioning apparatus which may realize air conditioning and which is less liable to produce an air stagnant section and providing the uniform temperature distribution.

Another object of the present invention is to provide an air conditioning apparatus which permits reduction of the noise caused by a sound produced by wind and also reduction of the deviated air flow affected by the dynamic pressure of conditioning air flow.

A further object of the present invention is to provide an air conditioning apparatus which may prevent the swirl, entrainment and counterflow of air current from generation by smoothly blowing conditioning air out of an air outlet to thereby improve in reduction of the noise and pressure loss.

Yet another object of the present invention is to provide an air conditioning apparatus which permits reduction of a fan motor in size by lessening the flow resistance of conditioning air flow to thereby reduce the consumption of power.

A still further object of the present invention is to provide an air conditioning apparatus which may prevent water resulting from dew condensation from scattering into a room by restraining the dew condensation from generation.

A still further object of the present invention is to provide an air conditioning apparatus which improves in external appearance when installed.

A still further object of the present invention is to provide an air conditioning apparatus which may widely diffuse conditioning air into a room in every directions under the heating and cooling operations.

Another object of the present invention is to provide an air conditioning apparatus which is good in operability.

These and other objects will become apparent from the summary and embodiments of the present invention which will be hereinafter described in detail.

An air conditioning apparatus according to the present invention is so structured that a duct box is directly or through a duct with an air conditioner provided with an air inlet port opening to a room, a heat exchanger and an air blower, a blow-off casing having an air outlet opening to the room is provided in the duct box to project into the room and a fan (a ceiling fan, a propeller fan, a stirring blower and a ceiling blower or the like are hereinafter simply referred to as a fan) is disposed below the blow-off casing.

Accordingly, room air drawn from the air inlet port into the air conditioner flows through the heat exchanger to be cooled or heated to provide conditioning air. The conditioning air is urged by the blower and then enters the duct box directly or through the duct. Then, the dynamic pressure component of the conditioning air is converted into static pressure in the duct box to provide the uniform flow of conditioning air which is then blown out of the air outlet into the room. The conditioning air is then stirred and mixed with the room air by the use of the fan to provide the conditioning air at a temperature approximately equal with room temperature and thereby gradually diffused into corners of the room.

As a result, cool air reaches to all of the corners of the room under the cooling operation, while warm air reaches to the floor of the room under the heating operation, so that a feeling of air conditioning may be improved in either case of cooling and heating operations.

Further, since a sound absorption material is applied to the inner surface of the duct box for converting the dynamic pressure component of the conditioning air flow into the static pressure, the conditioning air flow with much dynamic pressure components, which passes through the duct, comes to have the dynamic pressure component converted into the static pressure and the sound produced by air flow is absorbed by the sound absorption material.

As a result, not only is the noise level reduced, but also the conditioning air is blown out of the air outlet into the room as the uniform flow free from deviation. Therefore, since the stagnation of room air is eliminated to make the temperature distribution thereof uniform, it is possible to obtain a satisfactory feeling of air conditioning.

Further, an air conditioning apparatus according to the present invention includes an air outlet opening in the horizontal direction and provided in a lower portion of a blow-off casing projecting from a ceiling to a room, and a fan disposed below the air outlet, wherein a partition wall having a conical portion is provided between the air outlet and the fan to be opposed to the flow of conditioning air descending inside the blow-off casing, whereby the descending flow of conditioning air is diffused radially toward the air outlet, and turned into the horizontal direction.

Accordingly, the flow of conditioning air descending inside the blow-off casing is guided by the conical portion to be diffused radially toward the air outlet, and to be turned smoothly into the horizontal direction, so that the conditioning air may be blown out into the room through the air outlet in every direction.

Consequently, since the conditioning air flow is smoothly diffused by the conical portion of the partition wall in the radial direction and turned into the horizontal direction, there is no possibility of generation of the swirl, entrainment and counterflow of air current, so that the pressure loss and noise may be reduced. Further, since the conditioning air flow does not blow against a motor of the fan, the motor may be prevented from seizure, while the surface of the motor may be prevented from dew condensation to thereby prevent drain from scattering into the room.

Further, in the above air conditioning apparatus, the air outlet opening in the horizontal direction is formed in the lower portion of the blow-off casing over the whole periphery thereof, and a plurality of ringlike louvers are disposed on the air outlet.

Accordingly, the pressure in the blow-off casing is increased higher than the external pressure by the ring-like louvers disposed on the air outlet, while the air flow is put in order by each louver. Therefore, since the deviated distribution of velocity and the counterflow may be eliminated and then the conditioning air may be blown out of the air outlet into the room with the uniform velocity distribution. A feeling of air conditioning in the room may be improved.

Further, since use is made of the ring-like louvers formed into multiple stages, the above functions may be fulfilled more effectively.

An air conditioning apparatus according to the present invention comprises a conditioning air generator embedded in a ceiling, and a fan disposed below an air outlet for blowing out conditioning air generated by the conditioning air generator into a room, wherein the fan is capable of rotating forward and backward, whereby the conditioning air is blown out of the air outlet to the neighborhood of the ceiling in the room, then stirred and mixed with room air in the neighborhood of the ceiling by the use of the fan to provide the condition air at temperature approximately equal with room temperature, and gradually ascends or descends to be diffused into the room.

As a result, the temperature distribution in the room may be made uniform and any stagnant air section is eliminated from the room to thereby improve a feeling of air conditioning.

Also, an air conditioning apparatus of the present invention comprises a conditioning air generator embedded in a ceiling, and a fan disposed below an air outlet for blowing out conditioning air generated by the conditioning air generator into a room, wherein the fan is formed of an outer rotor motor provided below the air outlet and a plurality of blades fixedly attached to an outer peripheral surface of the outer rotor of the motor, whereby the conditioning air generated by the conditioning air generator is blown out of the air outlet through a duct, and stirred and mixed with room air by the use of the blades rotatably driven by the motor to be diffused into the room.

As a result, since the conditioning air does not flow through the inside of each hollow blade, a hollow shaft of a rotary fan and a boss, the flow resistance of air may be reduced, so that the motor may be reduced in size and also in consumption of power and noise.

Further, since each blade of the rotary fan does not need to be hollow and to be provided with a plurality of air outlets therein, the degree of freedom in design of the blade may be increased.

Furthermore, since the rotary fan is not cooled by the cool air under the cooling operation, the surface of each blade or outer rotor may be prevented from dew condensation.

Further, an air conditioning apparatus of the present invention comprises a conditioning air generator embedded in a ceiling, and a fan disposed below an air outlet for blowing out conditioning air generated by the conditioning air generator into a room, wherein the air outlet and fan are disposed in a recess provided on the ceiling or the wall surface facing to the room, whereby not only the appearance of the interior of the room may be improved, but also there is no possibility of giving the uncomfortable feeling to persons staying in the room or making the persons feel the narrowness of the room.

Another air conditioning apparatus of the present invention comprises a conditioning air generator embedded in a ceiling, and a fan disposed below an air outlet for blowing out conditioning air generated by the conditioning air generator into a room, wherein an oscillating mechanism is provided to oscillate the fan or the fan and outlet integrally, whereby the conditioning air is stirred and mixed with room air in the neighborhood of the ceiling by rotating the fan while oscillating to have a temperature approximately equal with room temperature to be diffused widely into the room.

As a result, since the temperature distribution in the room turns into the condition of keeping head cool and feet warm under the heating operation and any air stagnant section at low temperature is not produced in the room, a feeling of heating may be remarkably improved. Further, since the cool air is stirred and mixed with the room air in the neighborhood of the ceiling under the cooling operation to widely diffuse a great quantity of air at temperature approximately equal with room temperature into the room, a feeling of cooling may also be improved.

A further air conditioning apparatus of the present invention comprises a conditioning air generator embedded in a ceiling, and a fan disposed below an air outlet for blowing out conditioning air generated by the conditioning air generator into a room, wherein means for starting and stopping the fan in synchronization with the start and stop of the conditioning air generator is provided in an operation control device of the conditioning air generator, whereby it is not necessary to operate individually the operation control device of the conditioning air generator and that of the fan, so that if the conditioning air generator is operated, a comfortable feeling of air conditioning may be automatically obtained.

BRIEF DESCRIPTION OF THE DRAWINGS

FIGS. 7 and 8 are views similarly showing the temperature distribution in the room under the heating operation respectively, in which:

FIG. 7 is a view showing the case where a fan is rotated forward; and

FIG. 8 is a view showing the case where the fan is rotated backward;

FIGS. 13 through 18 are views showing an embodiment of the present invention, which is provided with an oscillating mechanism respectively, in which:

FIG. 13 is a sectional view showing the same;

FIG. 14 is a fragmentary enlarged-scale sectional view of FIG. 13;

FIG. 15 is a vertical sectional view showing the room temperature distribution under the heating operation in accordance with the embodiment;

FIG. 16 is a fragmentary sectional view showing another embodiment provided with an oscillating mechanism; and FIGS. 17 and 18 are sectional views showing further embodiments provided with the oscillating mechanism, respectively;

FIGS. 19 and 20 are views showing an operation control device of the air conditioning apparatus according to the present invention respectively, in which:

FIG. 19 is a general schematic view showing the same; and

FIG. 20 is an electric circuit diagram showing the same;

FIGS. 21 and 22 are views showing the room temperature distribution in the case where a prior art wall air conditioner is operated for heating respectively, in which:

FIG. 21 is a vertical sectional view showing the same; and

FIG. 22 is a horizontal section view showing the same;

FIGS. 23 and 24 are views showing the room temperature distribution in the case where warm air is blown out of an anemostat type air outlet of the prior art air conditioner respectively, in which:

FIG. 23 is a vertical sectional view showing the same; and

FIG. 24 is a horizontal sectional view showing the same;

FIGS. 25 and 26 are views showing the room temperature distribution in the case where the prior art wall air conditioner is used in combination with a fan respectively, in which:

FIG. 25 is a view showing the room temperature distribution in the case wherein the fan is rotated forward; and FIG. 26 is a view showing the room temperature distribution in the case where the fan is rotated backward;

DETAILED DESCRIPTION OF THE PREFERRED EMBODIMENT

Hereinafter will be described embodiments of the present invention in detail with reference to accompanying drawings.

Figure 1A:
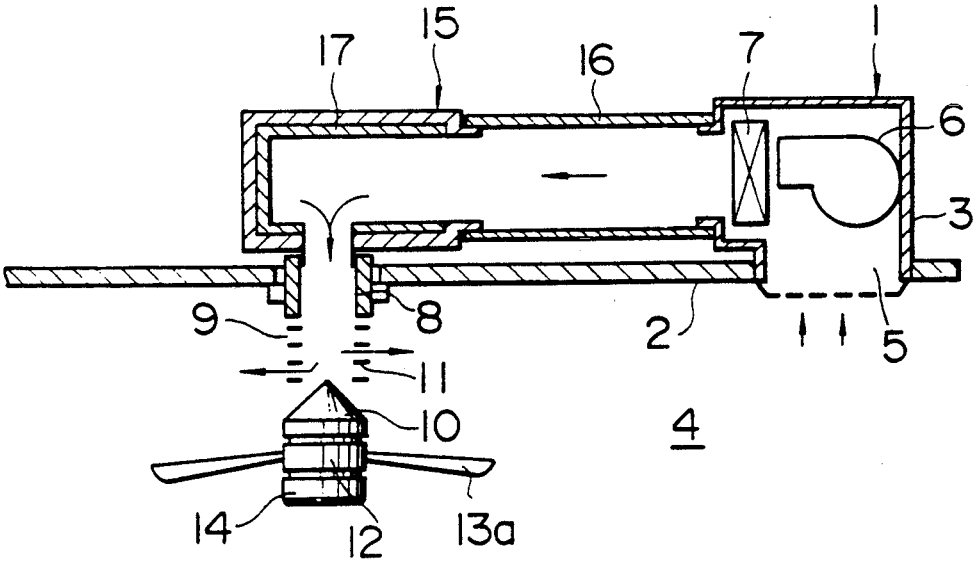
FIG. 1*a* is a schematic sectional view showing an air conditioning apparatus according to the present invention.
Figure 2:
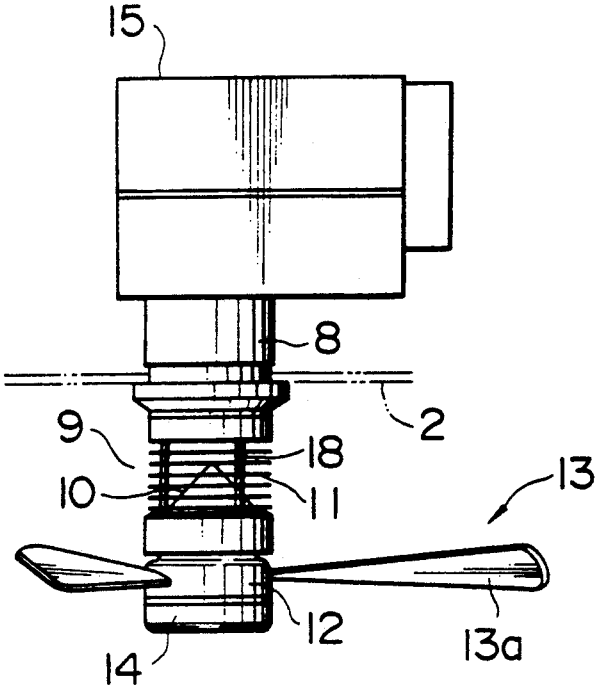
FIG. 2 is a front view showing the vicinity of a blow-off casing of the air conditioning apparatus.

Referring to FIGS. 1 and 2, reference numeral 1 designates a conditioning air generator, which is provided with a body 3 embedded in a ceiling 2, an air inlet port 5 opening to a room 4, and an air blower 6 and a heat exchanger 7 built in the body 3. Reference numeral 8 designates a cylindrical blow-off casing fixedly attached to the ceiling 2 and projecting into the room 4, and an air outlet 9 opening horizontally is formed in a lower portion of the blow-off casing 8 over the whole periphery thereof. A conical partition wall 20 is disposed within the lower portion of the blow-off casing 8 to be opposed to a flow of conditioning air descending through the blow-off casing 8, whereby the descending flow of conditioning air is diffused radially from the center toward the outer peripheral air outlet 9, and turned into the horizontal direction. Further, a plurality of ring-like louvers 11 are disposed in the air outlet 9 and held by a plurality of support rods 18 into the form of multiple stages so as to be uniformly spaced apart from each other in the vertical direction. A motor is disposed below the air outlet 9 and a plurality of blades 13*a* are fixedly attached to an outer peripheral surface of an outer rotor 12 of the motor. A propeller fan 13 formed of the plurality of blades 13*a* and the outer rotor 12 is rotatably driven by the motor in the forward or backward direction.

Figure 3:
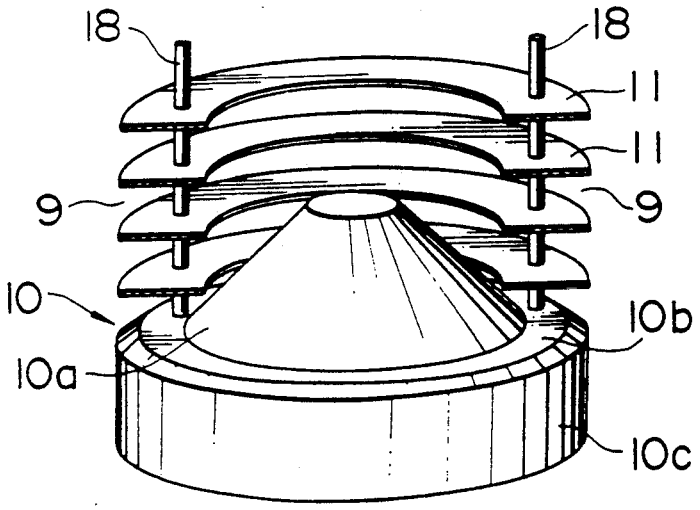
FIG. 3 is a perspective view showing a partition wall in the vicinity of the blow-off casing of the present apparatus.

As shown in FIG. 3, the partition wall 10 is provided with a conical portion 10*a* opposed to the flow of conditioning air descending through the blow-off casing 8 to thereby diffuse the descending flow of conditioning air radially from the center toward the outer periphery of the air outlet 9 while turning the descending flow of conditioning air into the horizontal direction, a bottom portion 10*b*, to which the support rods 19 are fixedly attached, and collar portion 10*c* for holding the outer rotor 12.

An upper end of the blow-off casing 9 is connected with a duct box 15, while the duct box 15 is connected with the body 3 of the conditioning air generator 1 through a duct 16. A sound absorption material 17 is applied to the whole inner surface of the duct box 15. Reference numeral 14 designates a luminaire disposed on a lower portion of the outer rotor 12.

Figure 1B:
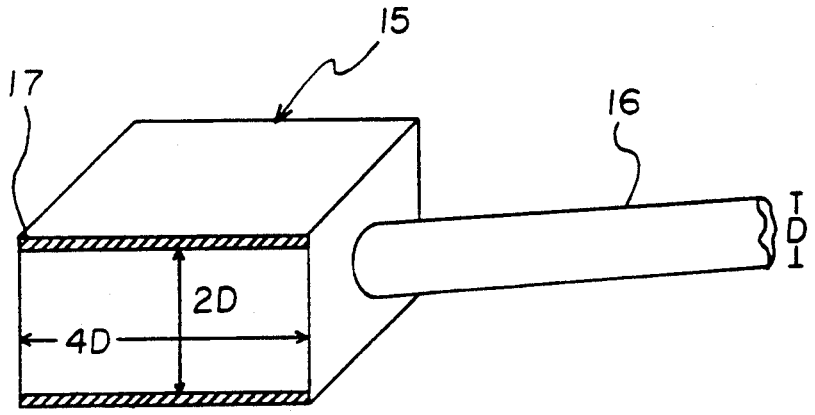
FIG. 1*b* is a schematic sectional view showing the expansion which takes place between the duct and the duct box due to the change in dimension from the duct to the duct box.

As can be seen in FIG. 1*b*, the duct 16 has a standard duct dimension substantially equal to the dimension D. According to the invention, the duct 16 feeds into the duct box 15 which has a width dimension much greater than the dimension D, for example four times the dimension D with a height dimension which is much greater than the dimension D, for example two times the dimension D. This allows a substantial expansion of the conditioned air which results in the dynamic pressure component of the conditioned air being converted into static pressure due to the expansion provided by the duct box 15. This has significant advantages according to the present invention as discussed below.

Figure 4:
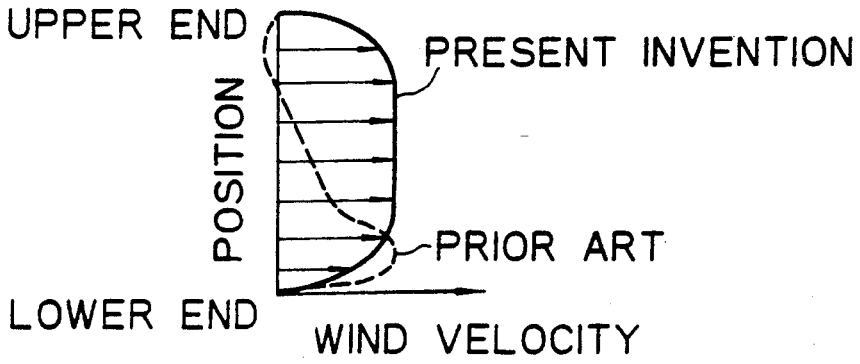
FIG. 4 is a graphic representation showing the distribution of flow velocity of conditioning air in an air outlet of the present invention.

Accordingly, air in the room 4 enters the body 3 from the inlet port 5 of the conditioning air generator 1. Then, the air is urged by the blower 6 and cooled or heated in a process of flowing the air through the heat exchanger 7 to provide conditioning air. The conditioning air enters the duct box 15 through the duct 16. Then, in the duct box 15, the dynamic pressure component of the conditioning air is converted into static pressure and a sound produced by air flow is absorbed by the sound absorption material 17. The conditioning air then descends through the blow-off casing 8 as a uniform air flow and is smoothly turned into the horizontal direction by the partition wall 10 while being diffused in the radial direction to provide the distribution of flow as shown by a solid line in FIG. 4, so that the conditioning air is put in order by the ring-like louvers 11 and changed in its flow direction to be blown out from the whole periphery of the air outlet 9 into the room 4 in every directions. Then, the conditioning air blown out into the room 4 is stirred and mixed with room air in the neighborhood of the ceiling 2 to provide the conditioning air at temperature approximately equal with room temperature, so that the resultant air is made to gently descend to be thereby diffused uniformly into the room 4.

Figure 5:
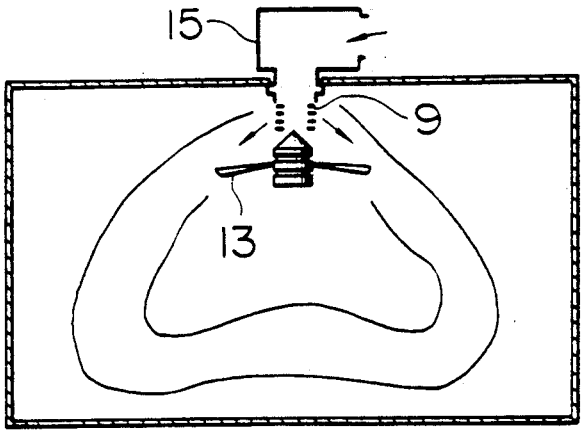
FIG. 5 is a vertical sectional view showing the temperature distribution in a room in accordance with the air conditioning apparatus of the present invention.
Figure 6:
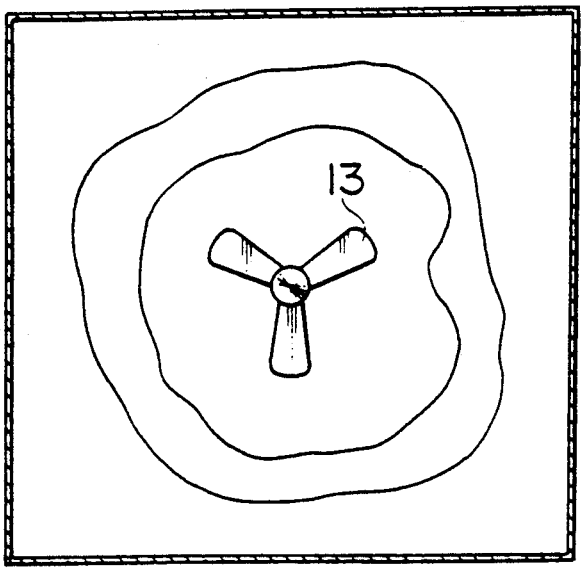
FIG. 6 is a horizontal sectional view similarly showing the temperature distribution in the room.

In consequence, the temperature distribution in the room 4 comes to be as shown in FIGS. 5 and 6, so that any air stagnant section is not produced in the room 4.

Figure 7:
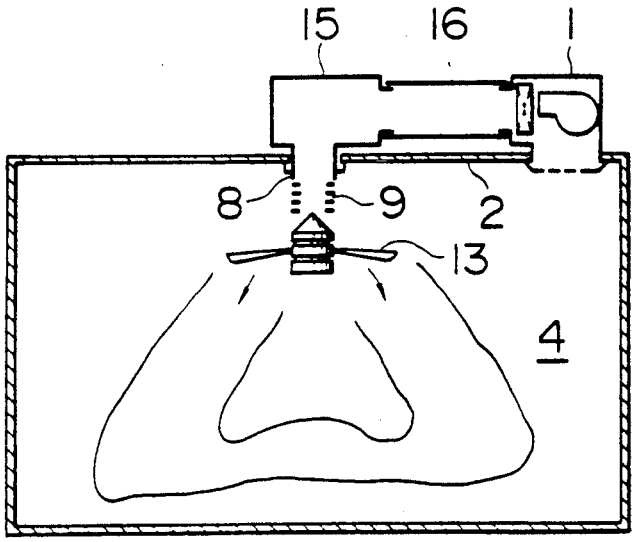
Figure 8:
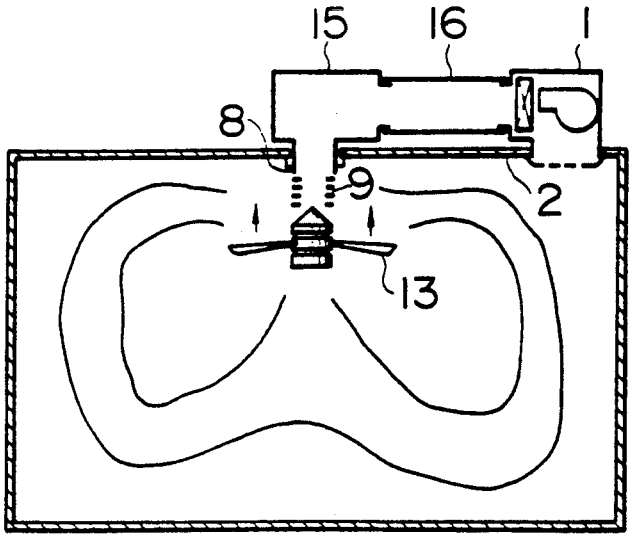

Further, when the propeller fan 13 is rotated forward under the heating operation, the air is gently descended and diffused into the room 4 to provide the temperature distribution as shown in FIG. 7. On the contrary, when the propeller fan 13 is rotated backward under the heating operation, the air is gently ascended and diffused into the room 4 to provide the temperature distribution as shown in FIG. 8.

Figure 9:
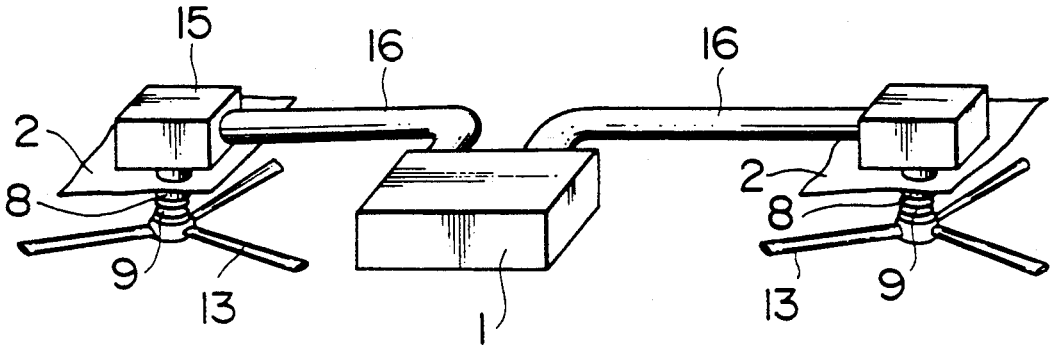
FIG. 9 is a perspective view showing another example of installment of the air conditioning apparatus according to the present invention.

Further, the conditioning air generator 1 is connected with one blow-off casing 8, while the generator 1 may be, of course, connected with a plurality of blow-off casings 8 as shown in FIG. 9.

Figure 10:
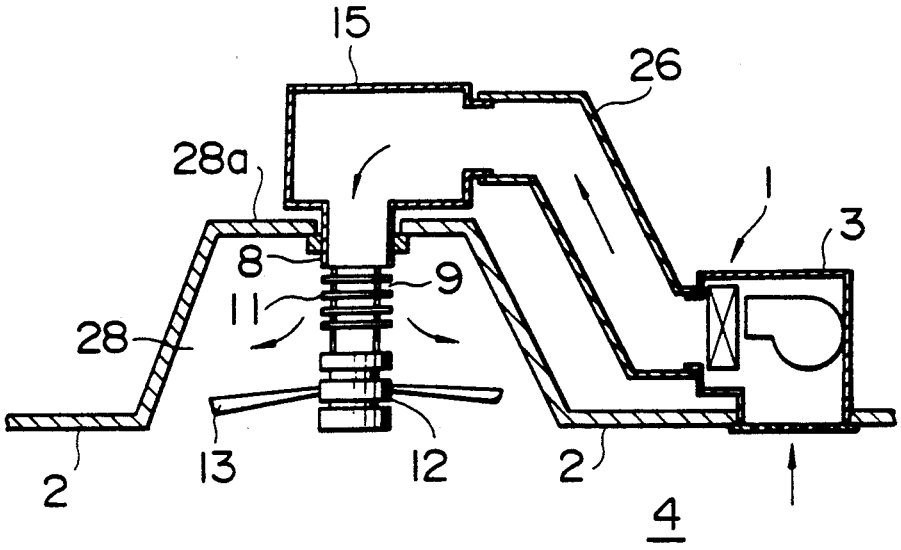
FIGS. 10 through 12 are vertical sectional views showing further examples of installment of the air conditioning apparatus, respectively.

The air conditioning apparatus may be installed under the condition as shown in FIG. 10. In this case, an inverted U-shaped recess 28 is provided on the ceiling 2 and the duct box 15 is fixedly attached to the back of the recess 28. The cylindrical blow-off casing 8 of the duct box 15 extends downward through the bottom 28*a* of the recess 28, and is provided with the air outlet 9 bored in a lower end of the casing 8 over the whole periphery thereof. The air outlet 9 opens to the recess 28. A plurality of ring-like louvers 11 are disposed into the form of multiple stages in the air outlet 9 so as to be uniformly spaced apart from each other in the vertical direction. The fan 13 is disposed below the air outlet 9 and rotatably driven by the outer rotor 12.

The duct box 15 is connected with the body 3 of the conditioning air generator 1 through the duct 26.

Figure 11:
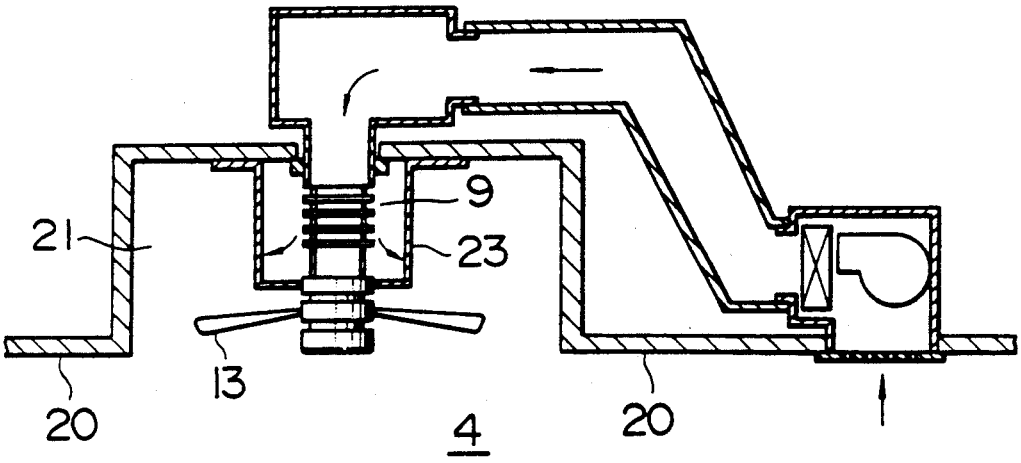
Figure 12:
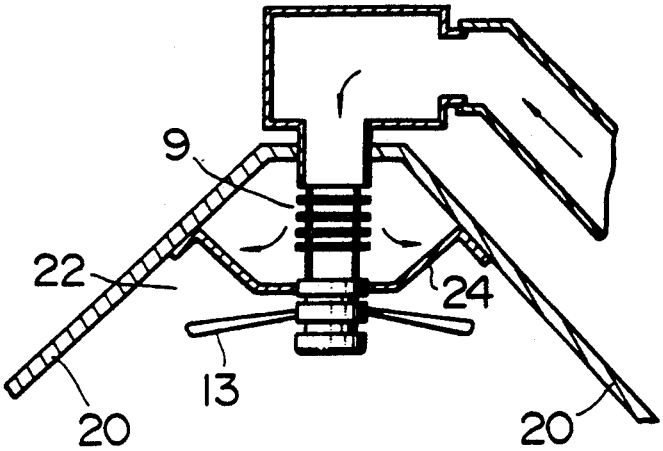

In the embodiment as noted above, the air outlet 9 and the fan 13 are disposed within the recess 28 provided on the ceiling 2, while a recess 21 may be provided on a wall surface 20 of the room 4 to dispose the air outlet 9 and the fan 13 within the recess 21, as shown in FIG. 11. Further, as shown in FIG. 12, the air outlet 9 and the fan 13 may be disposed within a corner 22 defined by the adjacent wall surfaces 20. Reference numerals 23, 24 designate fittings for supporting the fan 13.

Figure 13:
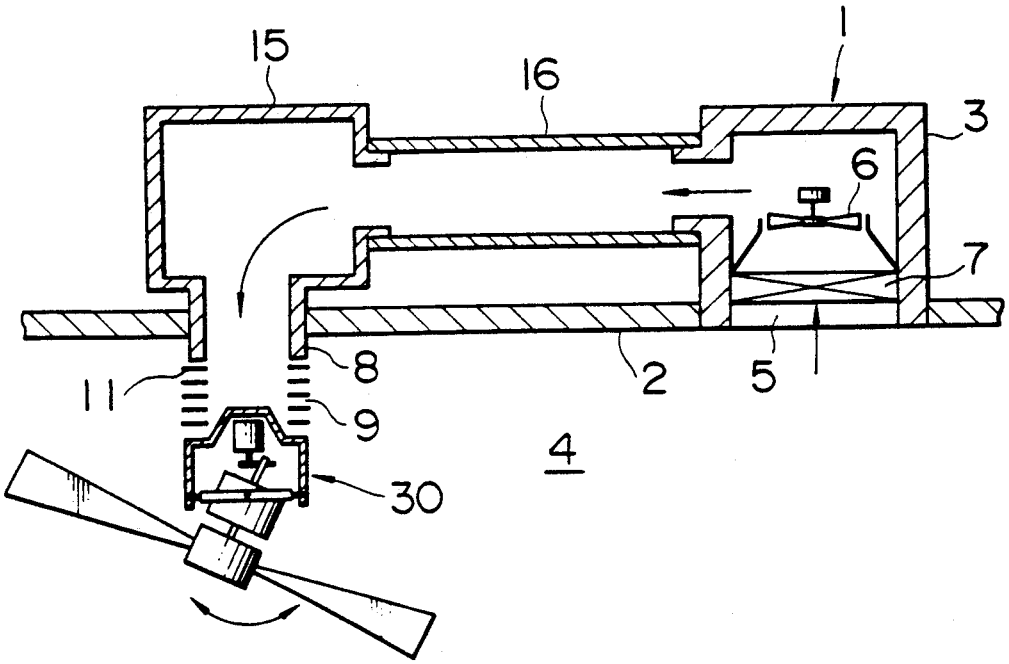
Figure 14:
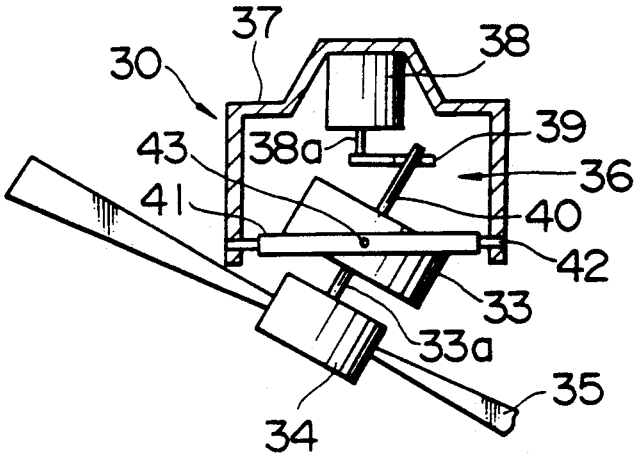

Further, in the above air conditioning apparatus, use may be made of a fan provided with an oscillating mechanism, as shown in FIGS. 13 and 14.

A fan 30 in this embodiment is provided with a motor 33, a boss 34 fixedly attached to a rotary shaft 33*a* of the motor 33, a plurality of blades 35 fixedly attached to an outer periphery of the boss 34 and extending in the radial direction and an oscillating mechanism 36. The oscillating mechanism 36 is composed of a motor 38 fixedly attached to a ceiling of a cap-like case 37, an arm 39 fixedly attached to a rotary shaft 38*a* of the motor 38, a rod 40 having one end brought into engagement with an end of the arm 39 so as to permit the swivel motion and the other end fixedly attached to the center of a top surface of the motor 33, an annular ring 41 disposed around the motor 33, a pair of pins 42 for supporting the ring 41 to be pivotable to the case 37, and a pair of other pins 43 extending through the center of the ring 41 and pivotally supporting the motor 33.

Accordingly, by driving the motor 33, a plurality of blades 35 are gently rotated through the rotary shaft 33*a* of the motor 33 and the boss 34. Further, the arm 39 is rotated through the rotary shaft 38*a* of the motor 38 by driving the motor 38. With the rotation of the arm 39, the rod 40 effects the swivel motion, while the ring 41 pivots about the pair of pins 42 and 43, so that the fan 30 permits the oscillating motion.

Under the heating operation, the room air drawn from the air inlet port 5 into the body 3 of the conditioning air generator 1 is heated in the process of flowing the air through the heat exchanger 7. Thereafter, the heated air is urged by the blower 6 and then guided from the air outlet 9 into the louvers 11 through the duct 16, duct box 15 and blow-off casing 8 to be blown out into the neighborhood of the ceiling 2 of the room 4 horizontally. Then, the air conditioning air is stirred and mixed with room air in the neighborhood of the ceiling 2 with the rotation of the fan 30 while oscillating to provide the conditioning air at temperature approximately equal with room temperature, so that the resultant air is gently descended to be widely diffused into the room 4.

Figure 15:
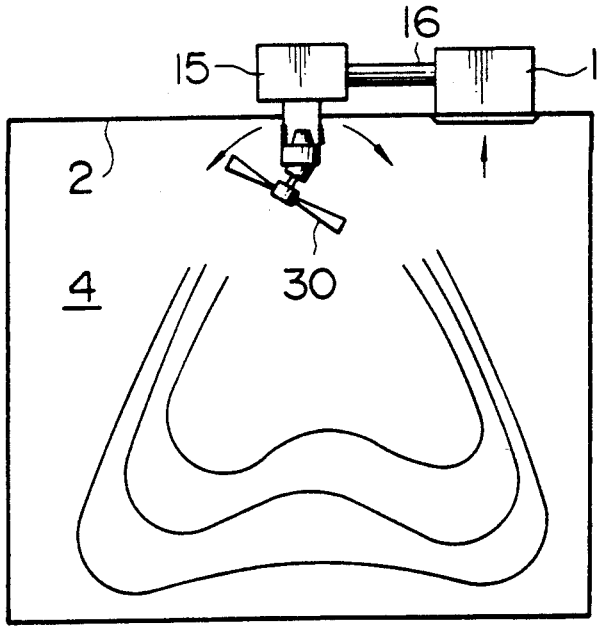

As a result, the temperature distribution in the room 4 comes to be as shown in FIG. 15, and any air stagnant section at low temperature is not produced in the room 4. Further, since the temperature distribution results in the condition of keeping ones head cool and feet warm, a feeling of heating may be remarkably improved.

Also, under the cooling operation, since the cool air blown out of the air outlet 9 is stirred and mixed with the room air in the neighborhood of the ceiling 2 by the use of the fan 30 disposed in proximity to the air outlet 9 and rotating while oscillating to provide the conditioning air at temperature approximately equal with room temperature to be diffused widely into the room, a feeling of cooling may also be improved.

Figure 16:
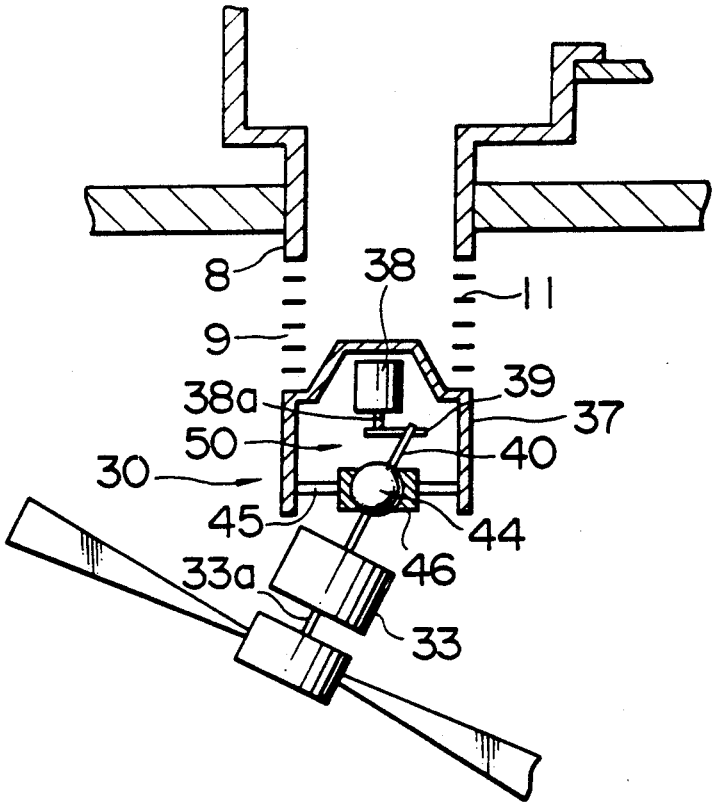

FIG. 16 shows another embodiment of the oscillating mechanism. An oscillating mechanism 50 is different from the oscillating mechanism 36 in that a ball 44 provided in the intermediate portion of the rod 40 is held in a housing 46 mounted in the case 37 through a stay 45 so that the ball 44 is capable of rolling in the housing 46. However, another constitution is similar to that of the oscillating mechanism 36, and the corresponding members are designated by the same reference numerals.

Also, in the embodiment, since the rotary shaft 38*a* and the arm 39 are rotated by driving the motor 38, and the rod 40 swivels around the ball 44 with the rotation of the rotary shaft 38*a* and arm 39, the fan 30 permits the oscillating motion.

Figure 17:
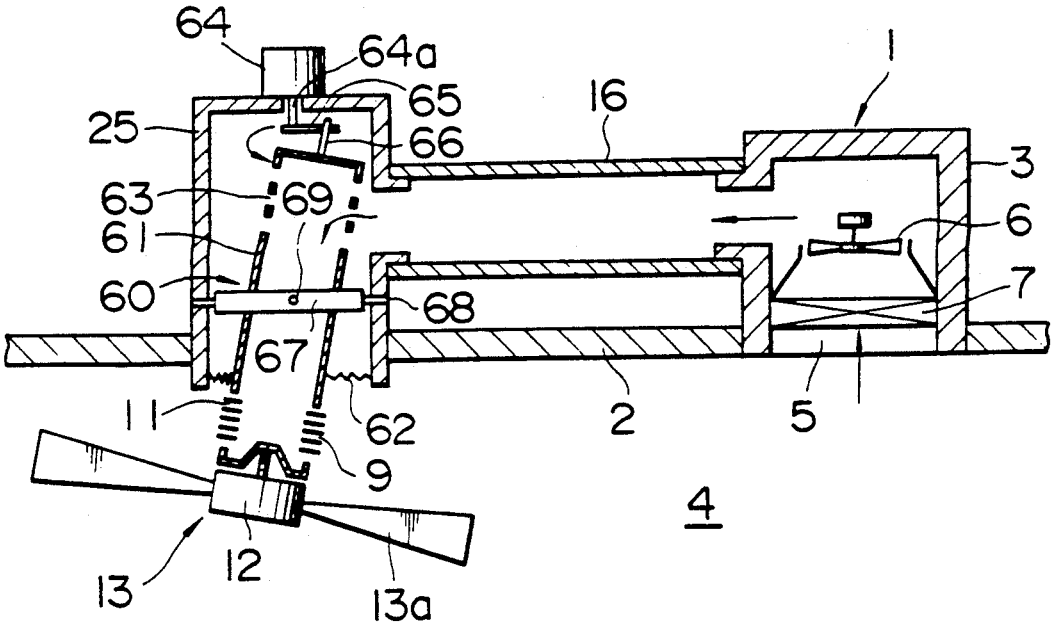

Further, use may be made of an oscillating mechanism structured as shown in FIG. 17. Namely, a cylindrical swing duct 61 oscillating by the oscillating mechanism 60 is disposed in the duct box 25, and extends into the room 4 through a lower end opening of the duct box 25. A clearance between the swing duct 61 and the duct box 25 is closed with a wind insulating canvas 62.

The swing duct 61 has an upper portion provided with a plurality of air inlets 63 and a lower portion provided with the air outlet 9 extending over the whole periphery thereof and opening to the neighborhood of the ceiling 2 in the room 4. A plurality of ring-like louvers 11 are disposed in the air outlet 9 into the form of multiple stages so as to be spaced apart from each other in the vertical direction.

Further, the fan 13 is disposed on the lower end of the swing duct 61 in the proximity to the air outlet 9. The fan 13 is provided with a plurality of blades 13*a* fixedly attached to the outer periphery of the outer rotor 12 of the motor and extending in the radial direction.

An oscillating mechanism 60 is composed of a motor 64 fixedly attached to an upper surface of the duct box 25, an arm 65 fixedly attached to a rotary shaft 54*a* of the motor 64, a rod 66 having one end brought into engagement with an end of the arm 65 so as to permit the swivel motion and the other end fixedly attached to the center of a top surface of the swing duct 61, an annular ring 67 disposed around the swing duct 61, a pair of pins 68 for supporting the ring 67 to be pivotal to the duct box 25, and a pair of other pins 69 for supporting the ring 67 to be pivotal about a pivot axis extending through the center of the ring 67 and orthogonal to the pivotal axis of the pin 68.

Accordingly, a plurality of blades 13*a* are gently rotated by driving the outer rotor 12 of the motor. Further, the arm 65 is rotated through the rotary shaft 64*a* of the motor 64 by driving the motor 64, and then the ring 67 pivots about the pins 68 and 69 with the rotation of the arm 65. By so doing, since the rod 66 and the swing duct 61 fixedly attached to the rod 66 effect the swivel motion, the air outlet 9 and the fan 13 are integrally oscillated.

Figure 18:
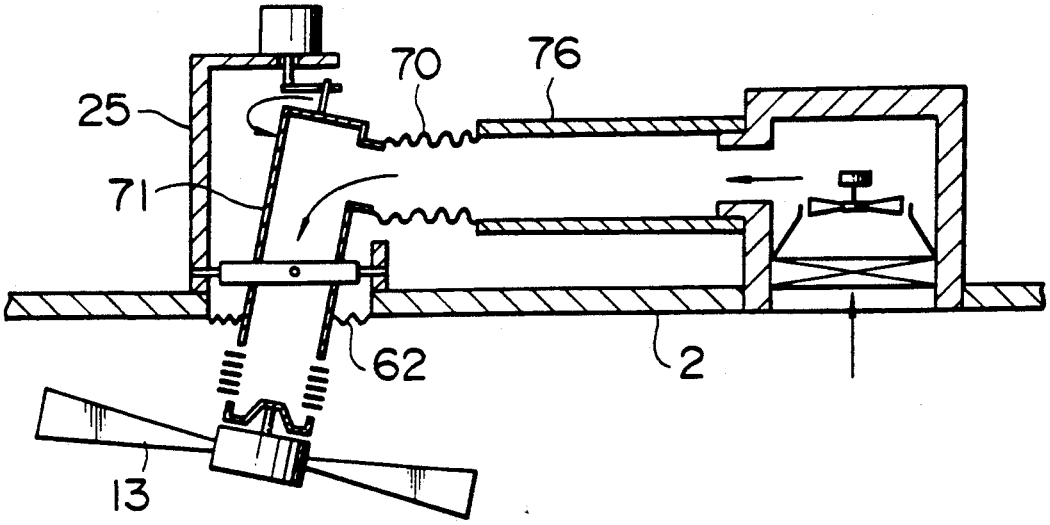

FIG. 18 shows a further embodiment, which is different from the above embodiment in that an upper portion of a swing duct 71 is connected with a duct 76 through a bellows 70 and the conditioning air directly flow from the duct 76 into the swing duct 71. However, another constitution and function are similar to those of the above embodiment, and the corresponding members are designated by the same reference numerals.

Figure 19:
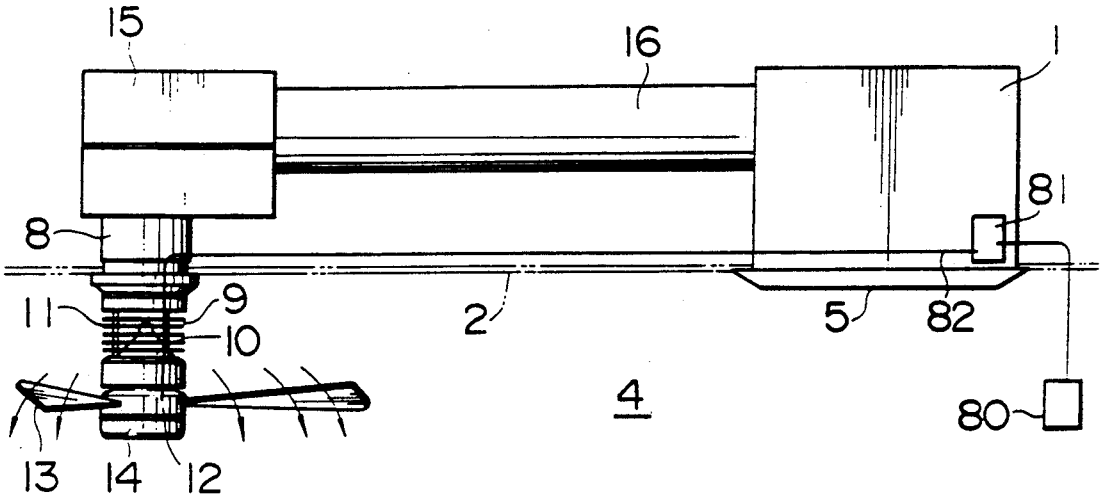
Figure 20:
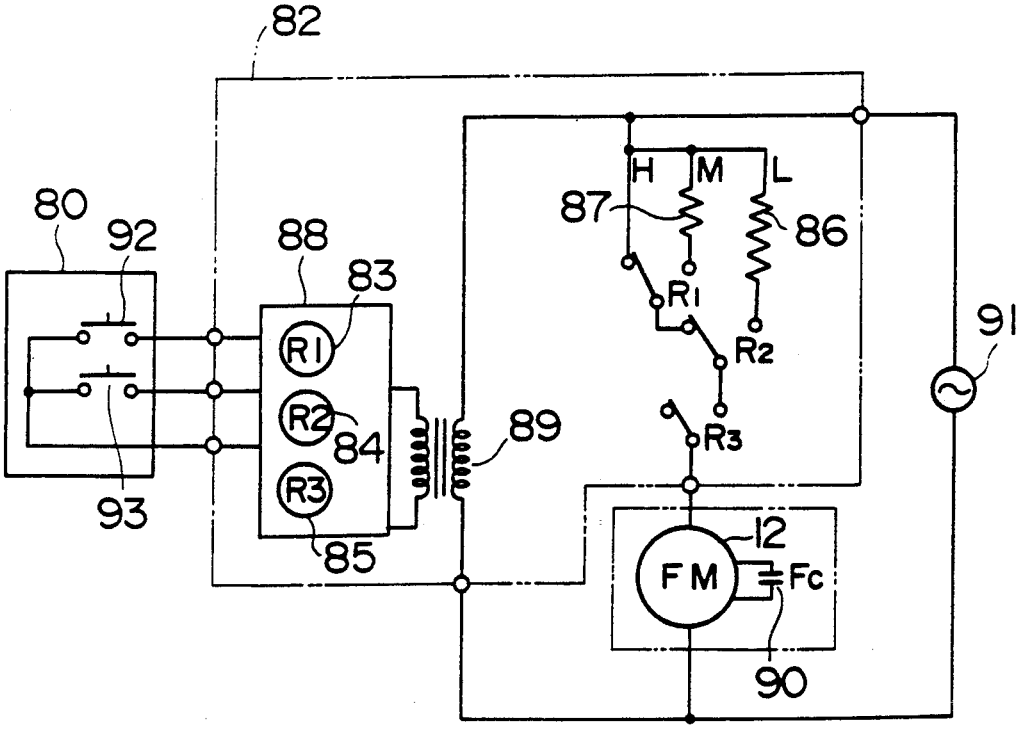
Figure 21:
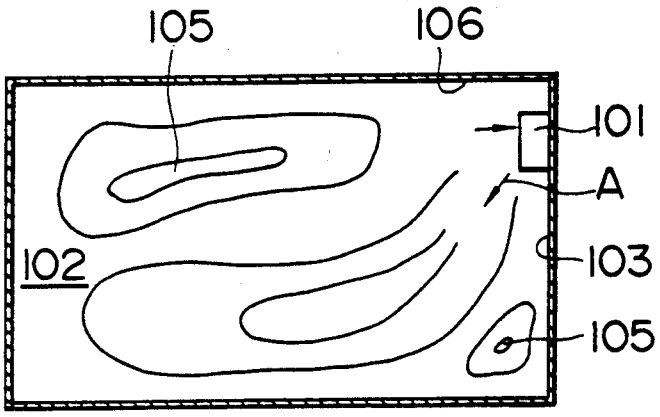
FIG. 21 (PRIOR ART)
Figure 22:
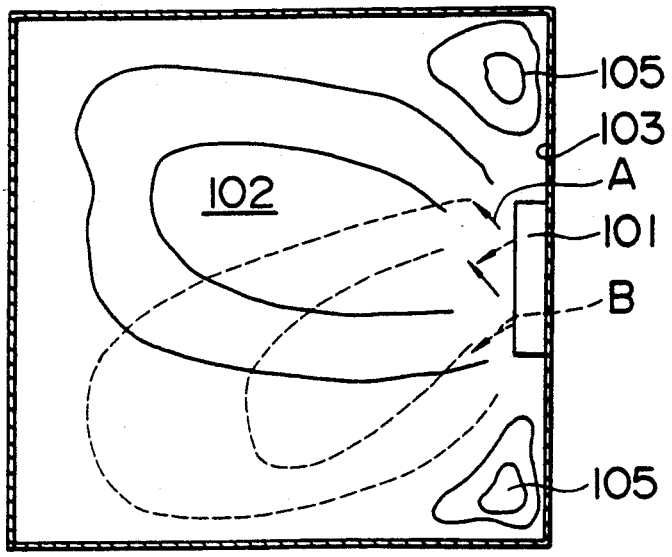
FIG. 22 (PRIOR ART)
Figure 23:
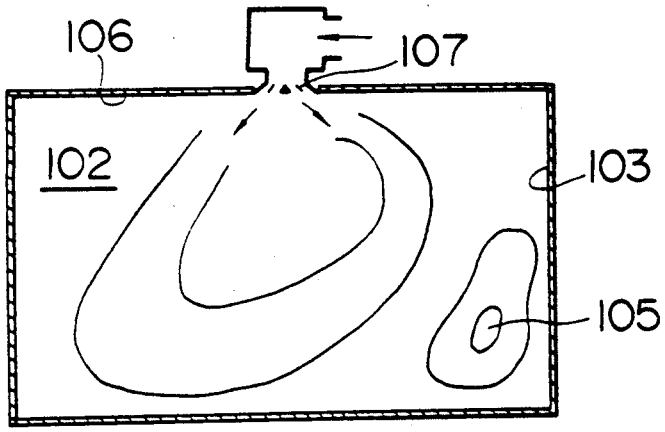
FIG. 23 (PRIOR ART)
Figure 24:
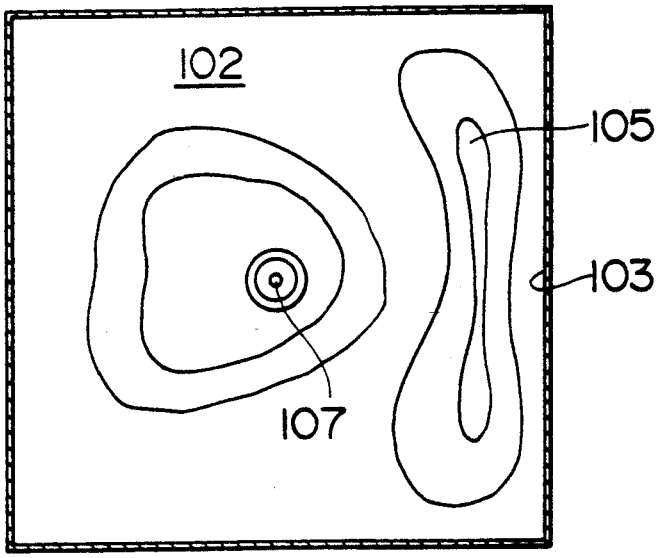
FIG. 24 (PRIOR ART)
Figure 25:
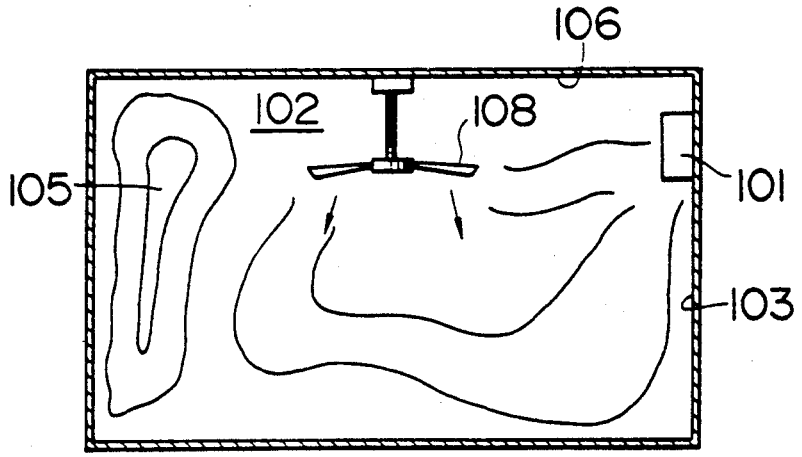
FIG. 25 (PRIOR ART)
Figure 26:
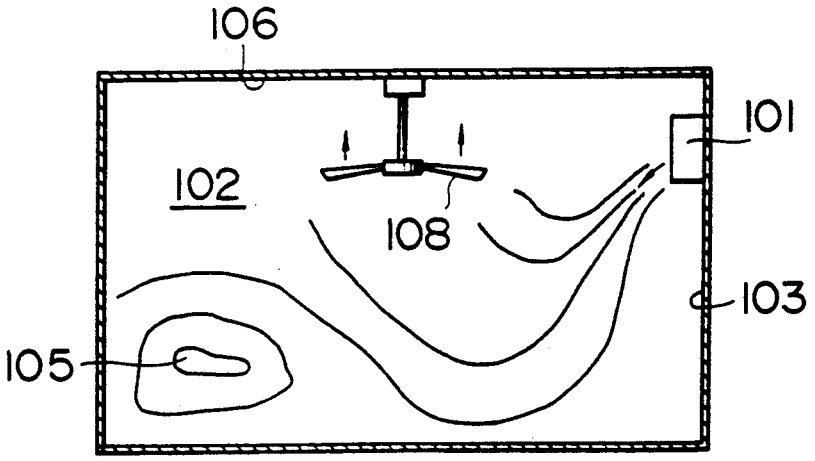
FIG. 26 (PRIOR ART)
Figure 27:
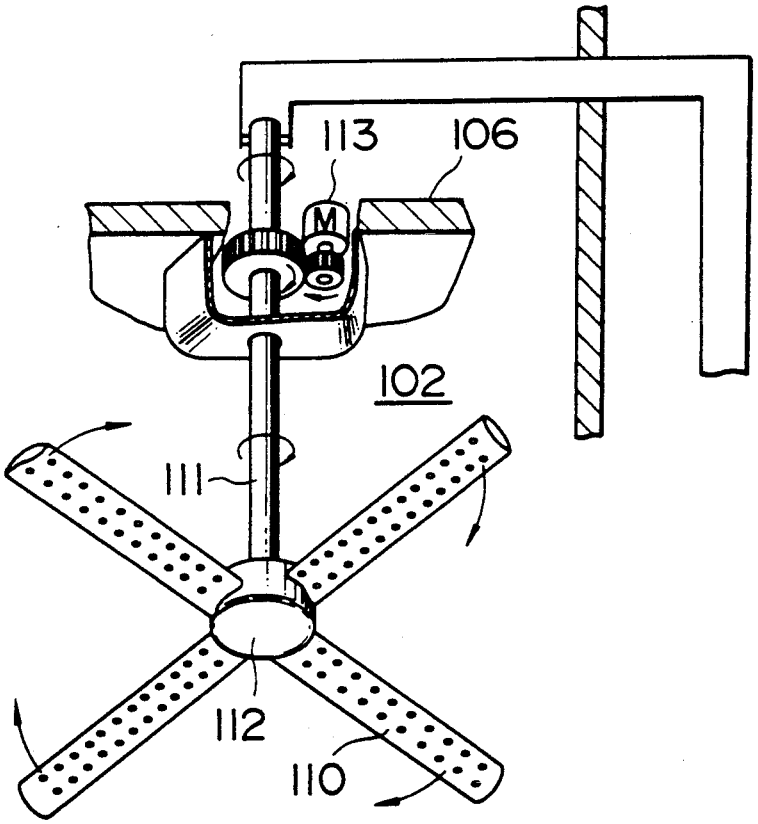
FIG. 27 (PRIOR ART)
FIG. 27 is a perspective view, partly in section, showing an air conditioning apparatus disclosed in Japanese Utility Model Application No. Sho 62-160812 filed by the present applicant.
Figure 28:
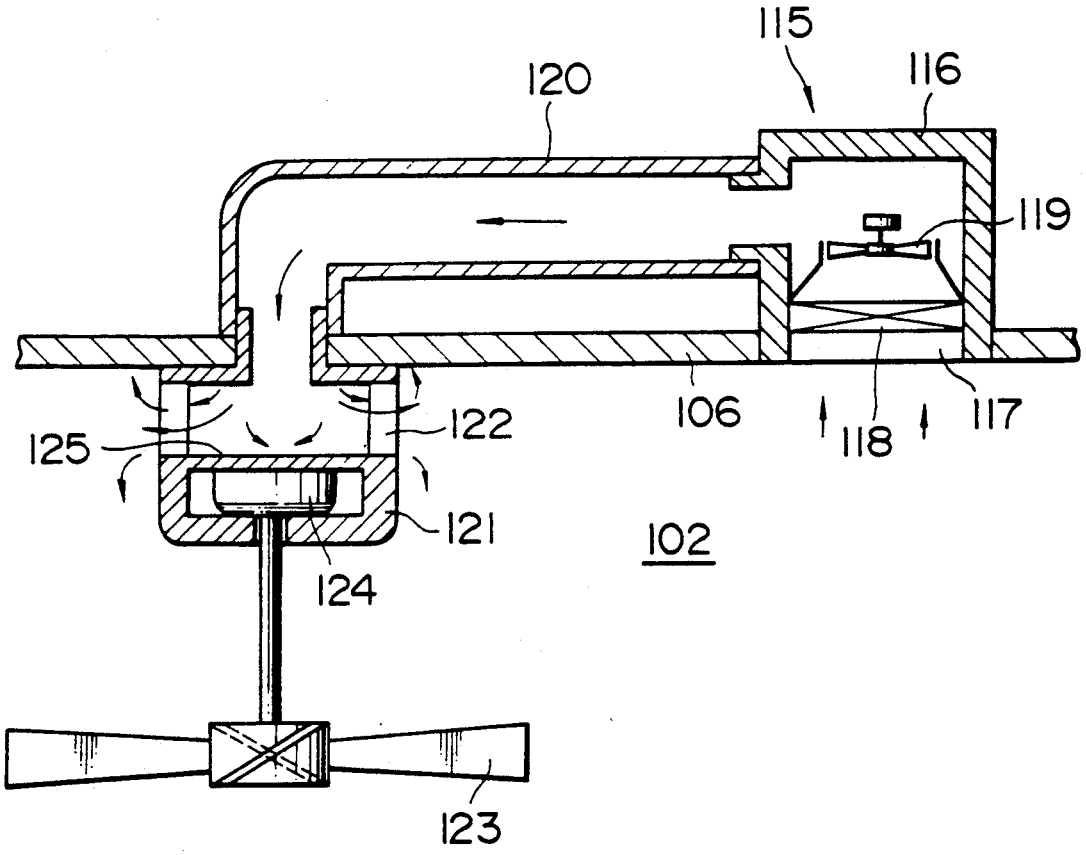
FIG. 28 (PRIOR ART)
FIG. 28 is a section view showing an air conditioning apparatus disclosed similarly in Japanese Utility Model Application No Sho 63-1248 filed by the present applicant.

Further, the air conditioning apparatus of the present invention may be operated by a control device as shown in FIGS. 19 and 20.

Reference numeral 80 designates an operation control device of the conditioning air generator 1, which is connected with a drive motor of the fan 13 through a control circuit 81 and a signal line 82, whereby the conditioning air generator 1 and the fan 13 are controlled by the operation control device 80.

An electric control system is shown in detail in FIG. 20. Referring to FIG. 20, reference numerals 83 and 84 designate speed relays of the fan 13, 85 a synchronous relay operated in synchronization with the conditioning air generator 1, 86 and 87 resistors for adjusting the speed of the fan 13, 88 an integrated circuit, 89 a transformer, 90 a capacitor, 91 a power source, 92 a switch for starting and stopping the conditioning air generator 1 and the fan 13, and 93 a rotational speed change-over switch of the fan 13.

When depressing the start/stop switch 92, a control circuit (not shown) is operated to activate the conditioning air generator 1, and the relay 95 is operated to render the contact $R_3$ thereof to be operative at the same time, so that fan 13 is rotated at high speed. When depressing the start/stop switch 92 once more, the conditioning air generator 1 and the fan 13 are stopped.

Further, when depressing the change-over switch 93, the relay 83 is operated to change over the contact $R_1$ thereof, and the fan 13 is then changed over in rotational speed from high speed (H) to medium speed (M). When further depressing the change-over switch 93, the relay 94 is operated to change over the contact $R_2$ thereof, and the fan 13 is then changed over in rotational speed from medium speed (M) to low speed (L).

As a result, the operation control device of the conditioning air generator and that of the fan are not necessary to be individually operated. Therefore, a comfortable feeling of air conditioning may be automatically obtained by the operation of the conditioning air generator.

What is claimed is:

1. An air conditioning arrangement for ceiling mounted heating and cooling air conditioning units, comprising: an air conditioner including a heating and a cooling arrangement and a heat exchanger, the air conditioner being positioned above a ceiling of a room and including an air inlet port opening toward the inside of the room, and an air blower for directing air with respect to said heat exchange; at least one duct having a dimension D, said duct being positioned above the ceiling of the room and conveying conditioned air from said air conditioner to a remote location; a duct box providing an expansion chamber, said duct box having a height dimension which is much larger than said dimension D and having a width dimension which is much larger than said dimension D, said duct box being connected to said duct and being positioned above the ceiling of the room; a blow-off casing connected to said duct box, said blow-off casing projecting into the room from above ceiling and having an air outlet opening to the room; a fan including a fan motor, said fan being connected to said blow-off casing, with fan blades and said fan motor being positioned extending into said room; and diffuser means, positioned between said air outlet and said fan for directing conditioning air radially outwardly between said air outlet and said fan.

2. An air conditioning arrangement according to claim 1, wherein said duct box includes an inner surface lined with sound absorption material, said duct box width and height providing an expansion of air flow for converting a dynamic pressure component of said air flow of conditioning air to static pressure.

3. An air conditioning arrangement according to claim 1, wherein said diffuser means includes a plurality of ring-like louvers disposed adjacent said air outlet for diffusing said air flow radially outwardly.

4. An air conditioning arrangement according to claim 3, wherein said plurality of ring-like louvers are positioned to form multiple stages of said diffuser.

5. An air conditioning apparatus, comprising:

an air conditioning main body imbedded in a ceiling of a room; a heat exchanger connected to said air conditioning main body for cooling or heating air; a blower for blowing out cooled or heated air, through said heat exchanger, into the room; an air suction inlet opening into the room for conducting air of the room into the air conditioning main body; a blow-off casing having a lower portion projecting from the ceiling of the room, said blow-off casing being connected to said air conditioning main body for blowing out air cooled or heated by said heat exchanger, said blow-off casing being connected to said air conditioning mean body via a duct; an air outlet provided in a lower portion of said blow-off casing projecting from the ceiling of the room; a fan disposed below said air outlet; and, diffuser means including a partition wall having a conical portion provided between said air outlet and said fan, said diffuser means for opposing flow of conditioning air descending through said blow-off casing for diffusing descending flow of conditioning air and directing the conditioning air in a radial direction, turned from a vertical direction into a horizontal direction.

6. An air conditioning apparatus, comprising: a conditioning air generator embedded in a ceiling; a heat exchanger connected to said conditioning air generator for cooling or heating air; a blower for blowing air through said heat exchanger to provide heated or cooled conditioned air; an air suction inlet opening in a room for conducting air of the room into the conditioning air generator; a glow-off casing connected to said conditioning air generator and including a lower portion projecting from said ceiling into the room, and including an air outlet for outputting conditioned air; a fan disposed below said air outlet for distributing conditioning air, generated by said conditioning air generator, into a room, said fan being rotatable forward and backward, and, diffuser means, positioned between said air outlet and said fan for directing conditioning air radially outwardly between said air outlet and said fan such that at least a portion of said conditioning air is redirected downwardly.

7. An air conditioning apparatus, comprising: a conditioning air generator embedded in a ceiling; a heat exchanger connected to said conditioning air generator for cooling or heating air; a blower for blocking air through said heat exchanger to provide heated or cooled conditioning air; an air suction inlet opening in a room for conducting air of the room into the conditioning air generator; a blow-off casing connected to said conditioning air generator and including a lower portion projecting from said ceiling into the room, and including an air outlet for outputting conditioned air; and a fan disposed below said air outlet for distributing conditioning air generated by said conditioning air generator into a room; diffuser means, positioned between sad fan and said outlet, the diffuser means extending downwardly from the ceiling for diffusing conditioning air and directing conditioning air radially outwardly, in a substantially horizontal direction, between said fan and the ceiling; such that at least a portion of said conditioning air is redirected downwardly and, an operation control device of said conditioning air generator; wherein said operation control device of said conditioning air generator is provided with means for starting and stopping said fan in synchronism with the start and stop of said conditioning air generator.

* * * * *